US009812241B2

(12) United States Patent
De La Cruz et al.

(10) Patent No.: US 9,812,241 B2
(45) Date of Patent: Nov. 7, 2017

(54) TRANSFORMER SECURITY ENCLOSURE

(71) Applicant: Hubbell Incorporated, Shelton, CT (US)

(72) Inventors: Ricardo De La Cruz, Zinacantepec (MX); Rodolfo Magaña, Metepec (MX); Edgar Bastida, Toluca (MX)

(73) Assignee: Hubbell Incorporated, Shelton, CT (US)

( * ) Notice: Subject to any disclaimer, the term of this patent is extended or adjusted under 35 U.S.C. 154(b) by 188 days.

(21) Appl. No.: 14/790,252

(22) Filed: Jul. 2, 2015

(65) Prior Publication Data

US 2016/0007490 A1 Jan. 7, 2016

Related U.S. Application Data

(60) Provisional application No. 62/020,457, filed on Jul. 3, 2014.

(51) Int. Cl.
*H02G 3/08* (2006.01)
*H01F 27/04* (2006.01)
*H01F 27/02* (2006.01)

(52) U.S. Cl.
CPC ..... *H01F 27/04* (2013.01); *H01F 27/02* (2013.01)

(58) Field of Classification Search
CPC .... H05K 5/0221; H05K 5/004; H05K 5/0217; H05K 5/02; H05K 5/0204; H05K 5/00; H02G 3/08; H02G 3/081; H01F 27/02; H01F 27/04; H01F 27/06; H02B 1/50; H02B 3/00; H02B 3/01; H02B 5/00; H02B 7/00; H02B 1/01; H02B 1/00
USPC ..... 174/50, 535, 17 R, 520, 559; 361/600, 361/601, 602, 603, 620, 623, 641; 312/223.1, 223.6; 336/90, 94
See application file for complete search history.

(56) References Cited

U.S. PATENT DOCUMENTS 1,816,034 A 7/1931 Wood
3,014,158 A * 12/1961 Nelson ..... H01F 27/06 174/50
3,249,817 A 5/1966 Sinclair et al.
3,376,086 A * 4/1968 Fisher ..... H02B 1/50 174/50

(Continued)

FOREIGN PATENT DOCUMENTS

EP 0348131 12/1989
EP 2571034 3/2013

(Continued)

OTHER PUBLICATIONS

PCT/US2015/038966 International Search Report and Written Opinion dated Oct. 5, 2015.

*Primary Examiner* — Angel R Estrada
(74) *Attorney, Agent, or Firm* — Michael Best & Friedrich, LLP

(57) ABSTRACT

A security enclosure for a transformer includes a first sidewall, a second sidewall, and a bottom at least partially enclosing an interior. The bottom has an aperture configured to receive a transformer tank. A front opening provides access to an interior having a first panel. At least one terminal block is connected to the first panel. A door pivots between an open position spaced from the front opening and a closed position covering the front opening.

19 Claims, 8 Drawing Sheets

(56) References Cited

U.S. PATENT DOCUMENTS

| | | | | |
|---|---|---|---|---|
| 4,123,618 | A * | 10/1978 | Cushing | H01B 17/26 174/15.3 |
| 4,556,758 | A * | 12/1985 | Warden | H01F 27/02 174/50 |
| 5,783,775 | A * | 7/1998 | Marusinec | H01F 27/06 174/50 |
| 7,324,332 | B1 * | 1/2008 | Shelton | H02B 1/50 174/50 |
| 7,636,233 | B2 * | 12/2009 | Callsen | H02B 3/00 174/520 |
| 7,663,461 | B2 * | 2/2010 | Brosig-Rodriguez | H01F 27/02 174/50 |
| 7,915,558 | B2 | 3/2011 | Nelson et al. | |
| 8,273,984 | B2 * | 9/2012 | Combs | E05B 67/383 174/50 |
| 8,440,913 | B2 | 5/2013 | Stull et al. | |
| 8,456,814 | B2 * | 6/2013 | Gerovac | H02B 1/301 174/50 |
| 2003/0168232 | A1 | 9/2003 | Wiebe et al. | |
| 2007/0102180 | A1 | 5/2007 | Brosig-Rodriguez et al. | |
| 2011/0090667 | A1 | 4/2011 | Wilson et al. | |
| 2011/0292563 | A1 | 12/2011 | Head | |
| 2011/0298287 | A1 | 12/2011 | Cobb et al. | |
| 2013/0194774 | A1 | 8/2013 | Ward et al. | |

FOREIGN PATENT DOCUMENTS

| | | |
|---|---|---|
| GB | 2107527 | 4/1983 |
| JP | 2011151158 | 8/2011 |

* cited by examiner

TRANSFORMER SECURITY ENCLOSURE

RELATED APPLICATIONS

This application is based on U.S. Provisional application Ser. No. 62/020,457, filed Jul. 3, 2014, the disclosure of which is incorporated herein by reference in its entirety and to which priority is claimed.

FIELD

Enclosure for a transformer low voltage connection and closeable access openings.

BACKGROUND

Overhead distribution transformers are used throughout the power network to step down high voltage to a lower voltage for distribution to a customer and are typically mounted on a utility pole, a pad, or underground. Overhead distribution transformers have a tank that houses the transformer core and coils. A primary coil extends from the tank and connects to a high voltage power line. One or more low voltage bushings extend from the tank to provide a low voltage output.

SUMMARY

According to an exemplary embodiment, a security enclosure for a transformer includes a first sidewall, a second sidewall, and a bottom at least partially enclosing an interior. The bottom has a tank aperture. A front opening provides access to an interior having a first panel positioned therein. At least one terminal block is connected to the first panel. A door pivots between an open position exposing the front opening and a closed position covering the front opening.

According to another exemplary embodiment, a security enclosure for a transformer includes a first sidewall, a second sidewall, and a bottom at least partially enclosing an interior. The bottom has a tank aperture. A front opening provides access to the interior and a first panel is positioned therein. At least one terminal block is connected to the first panel. A top cover slidable between a closed position and an open position selectively covers the interior. A door pivotable between an open position and a closed position covers the front opening. A lock is connected to the top cover.

According to an additional exemplary embodiment, a security enclosure for a transformer includes a first sidewall, a second sidewall, a top wall, and a bottom wall at least partially enclosing an interior. The bottom wall has a tank aperture to receive a transformer tank. A hook extends from the top wall. A shaft extends from the top wall. A front opening provides access to the interior, and a first panel is positioned therein. At least one terminal block is connected to the first panel. A door pivotable between an open position and a closed position covers the front opening. A lock is configured to secure the front door in the closed position.

A further exemplary embodiment includes a transformer having a secure enclosure. The transformer has a tank and a low voltage bushing extending from said tank. The enclosure is connected to the transformer and has a first sidewall, a second sidewall, and a bottom at least partially enclosing an interior around the low voltage bushing. A front opening provides access to the interior, and a first panel is positioned therein. At least one terminal block is connected to the first panel and electrically connected to the low voltage bushing. A door pivotable between an open position and a closed position covers the front opening.

BRIEF DESCRIPTION OF THE DRAWINGS

The above aspects and features of the present invention will be more apparent from the description of the exemplary embodiments of the present invention taken with reference to the accompanying drawings, in which.

DETAILED DESCRIPTION OF EXEMPLARY EMBODIMENTS

Figure 3:
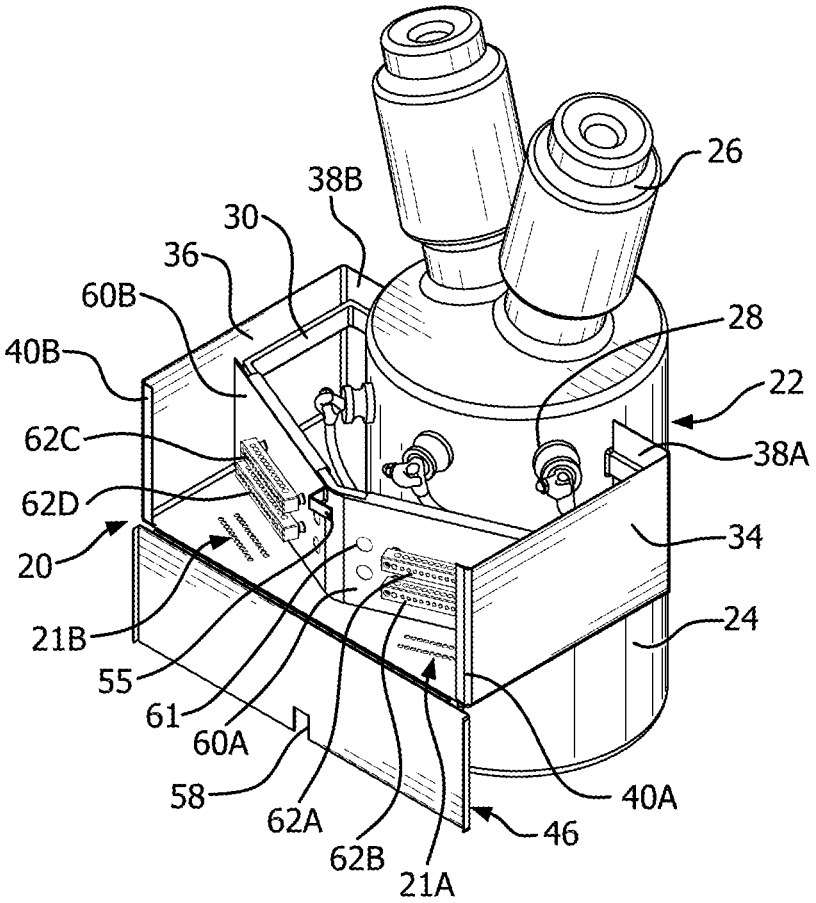
FIG. 3 is a top perspective of the transformer and security enclosure of FIG. 1 with the top cover removed and the front door opened.
Figure 4:
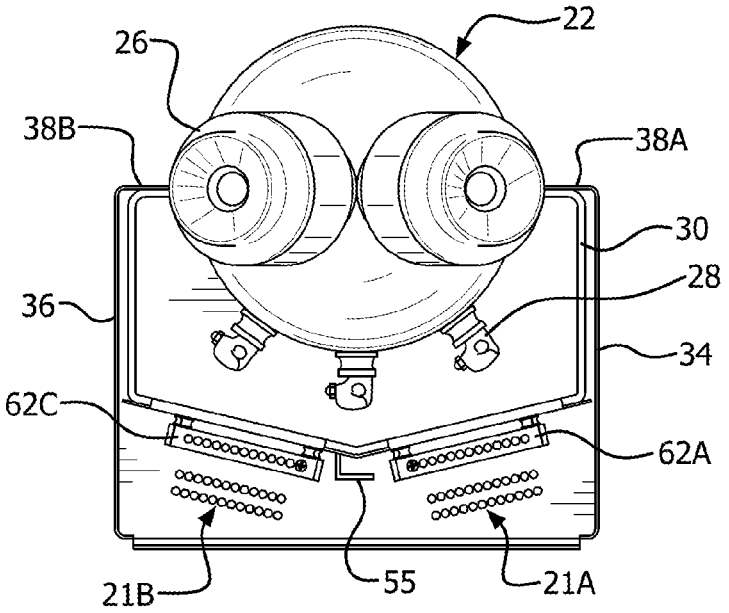
FIG. 4 is a top view of the transformer and security enclosure of FIG. 3.
Figure 5:
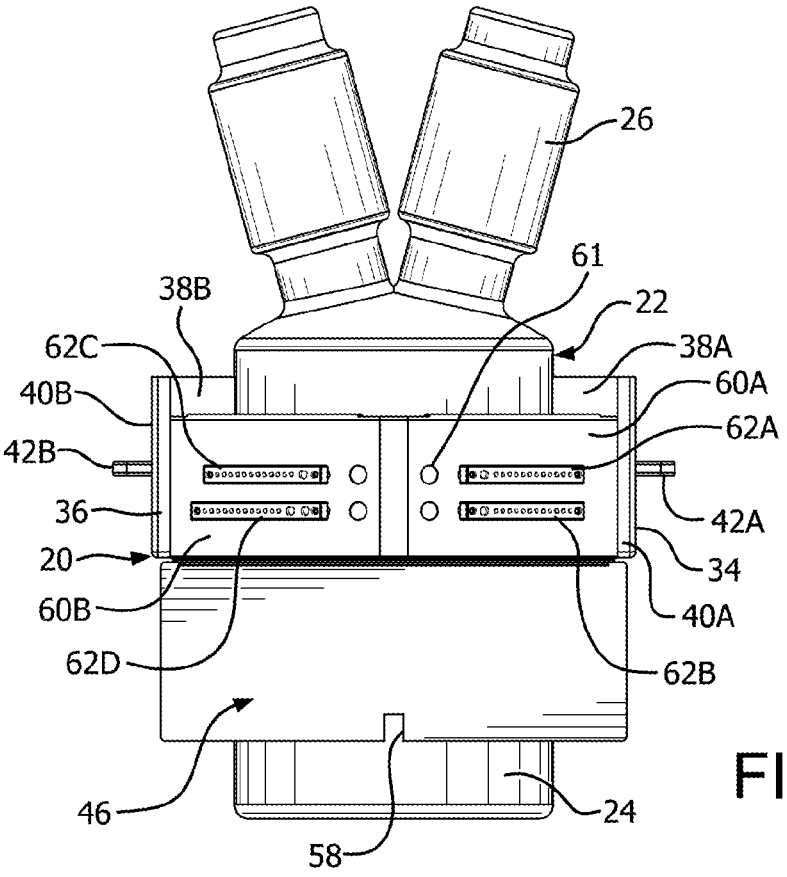
FIG. 5 is a front view of the transformer and security enclosure of FIG. 3.

In accordance with various exemplary embodiments, a security enclosure 20 protects the low voltage output connections of a transformer 22. The transformer 22 includes a tank 24, one or more high-voltage bushings 26, and one or more low voltage bushings 28, for example three low voltage bushings 28. As best shown in FIG. 3, a top bar 30 extends from the tank 24. The top bar 30 may be initially included on the tank 24, for example, as a lifting or positioning bar, or it may be retrofitted to the tank. Other structures such as lifting lugs may be provided on the tank 24 depending on the design and configuration of the transformer 22. Different transformers can have different structures as would be understood by one of ordinary skill in the art, and the size, shape, and configuration of the security enclosure 20 can be modified accordingly. The security enclosure 20 assists in preventing unauthorized access and unauthorized connections from being made to the low voltage bushings 28.

Figure 6:
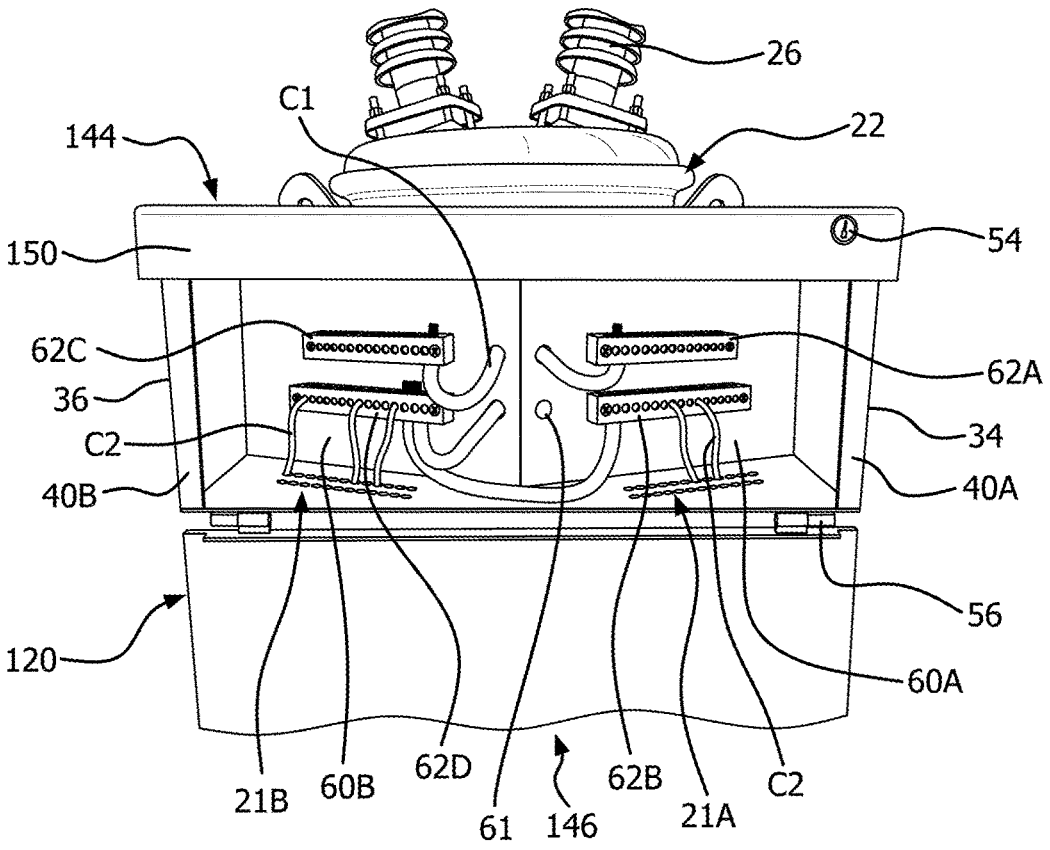
FIG. 6 is a front view of a transformer and a security enclosure according to another exemplary embodiment.
Figure 7:
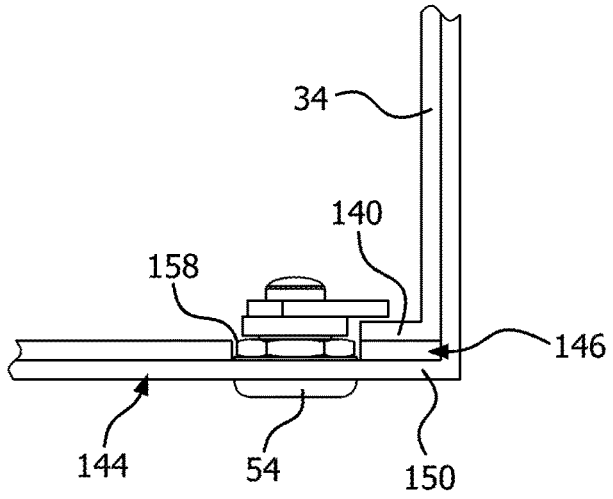
FIG. 7 is an enlarged, top view of the transformer and security enclosure of FIG. 6 with the front door closed and the top cover and front door secured by the lock.
Figure 8:
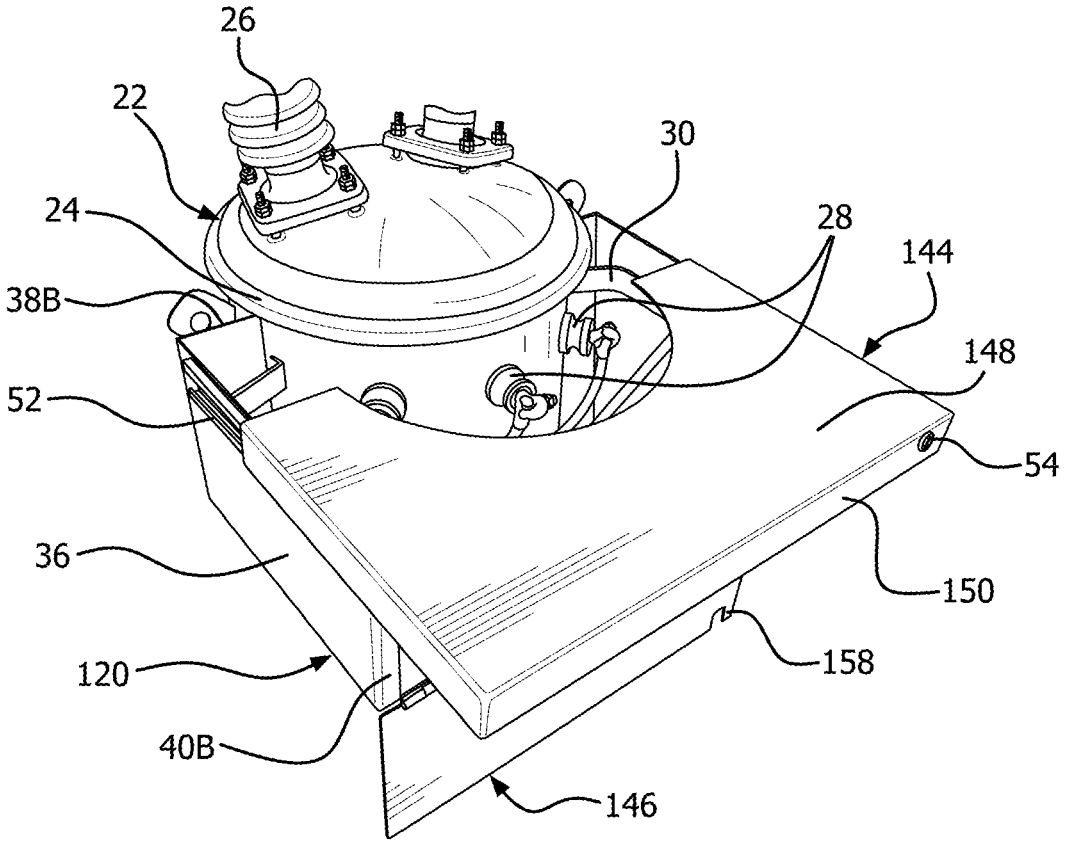
FIG. 8 is a top perspective view of the transformer and security enclosure of FIG. 6.
Figure 9:
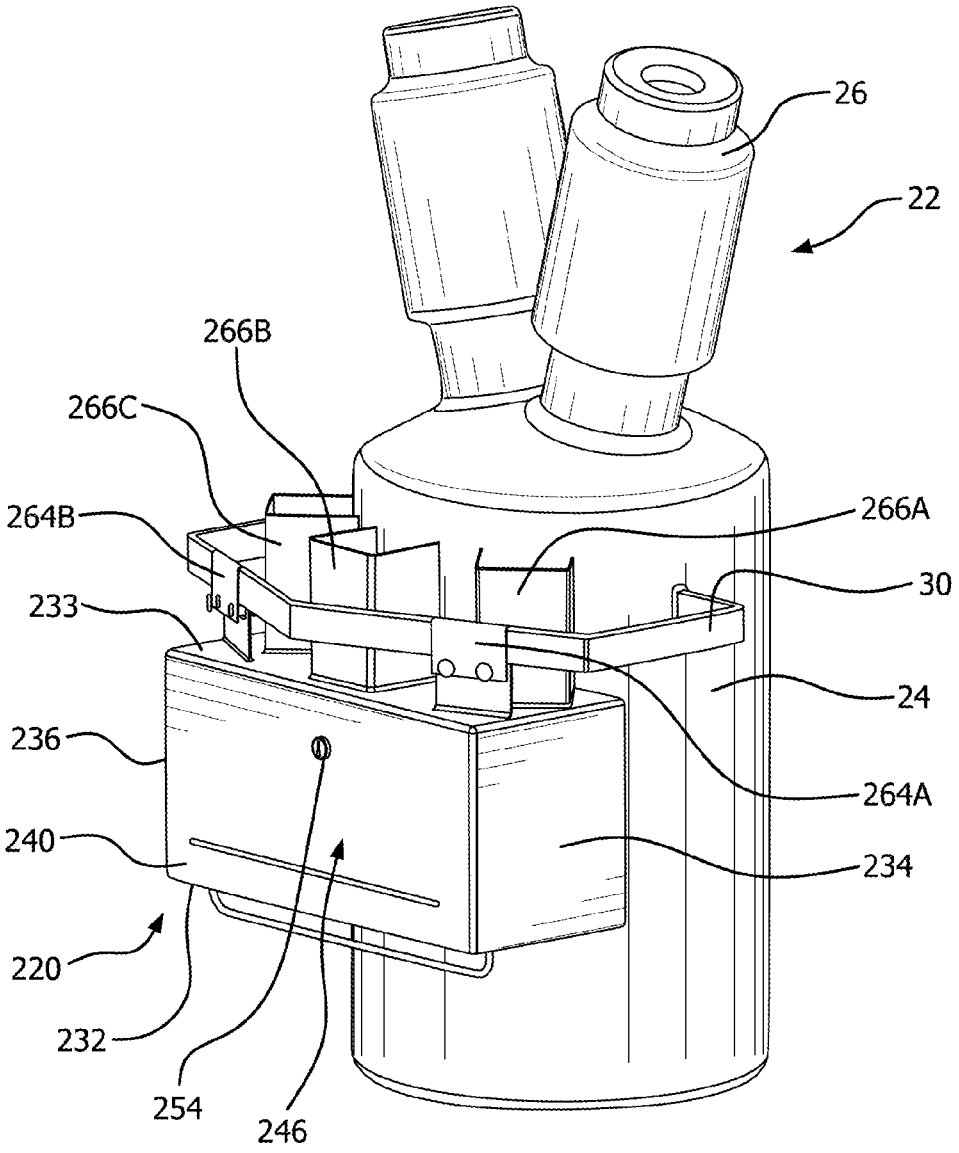
FIG. 9 is a right side perspective view of a transformer and a security enclosure according to another exemplary embodiment.
Figure 10:
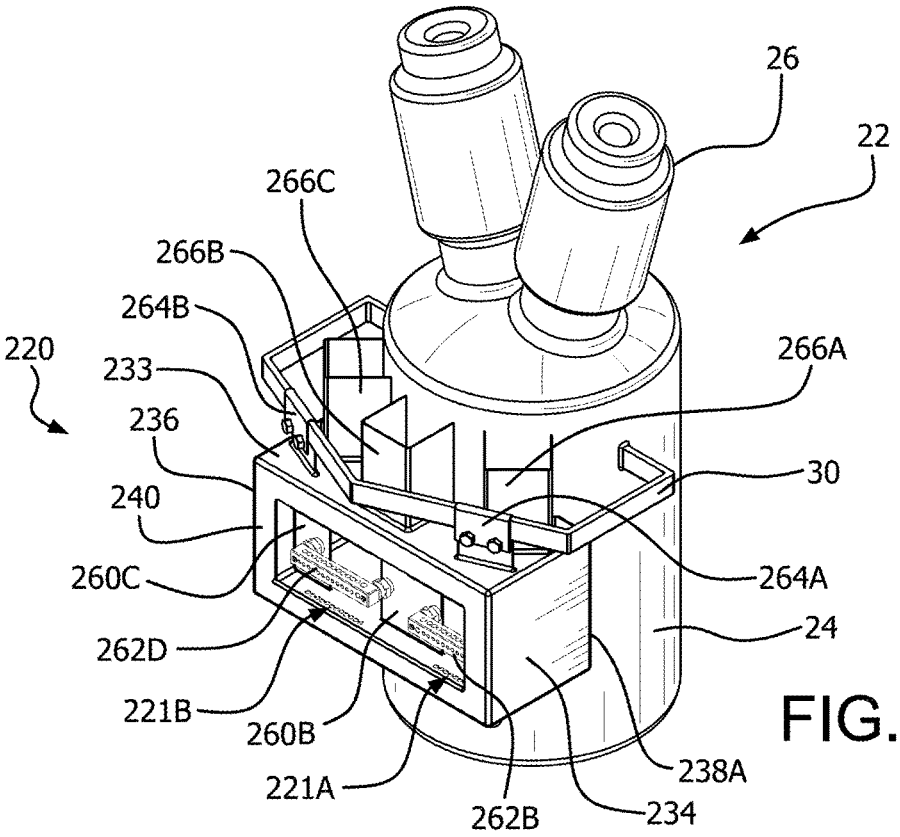
FIG. 10 is a top perspective view of the transformer and a security enclosure of FIG. 9 with the front door removed.
Figure 11:
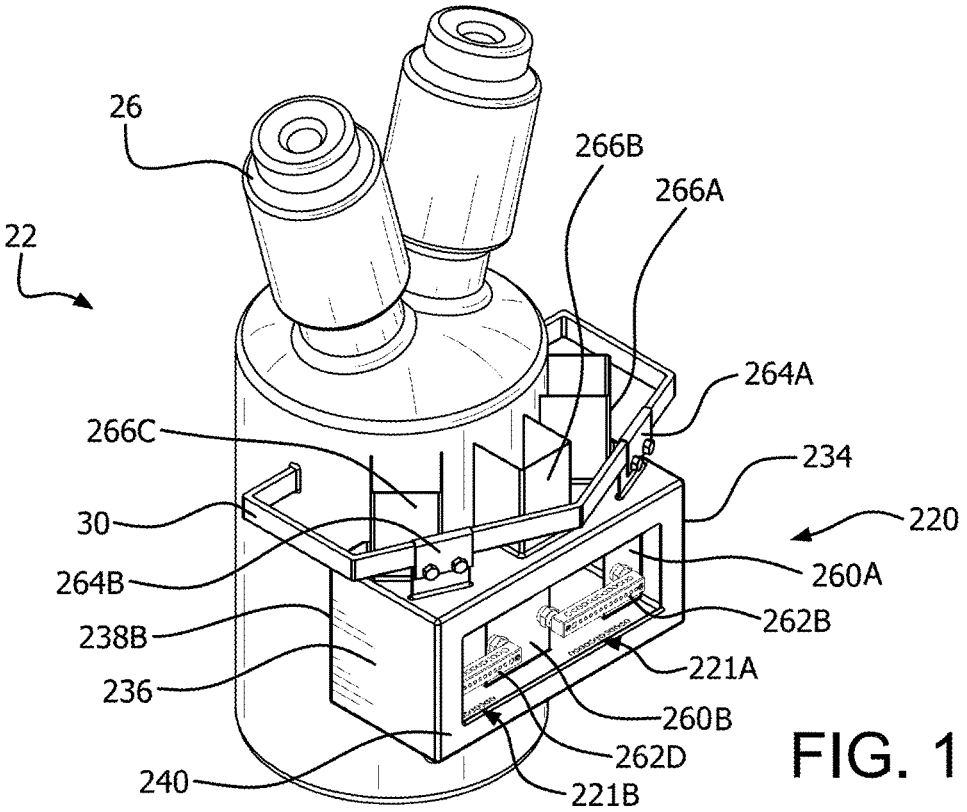
FIG. 11 is a top perspective view of the transformer and security enclosure of FIG. 10.
Figure 12:
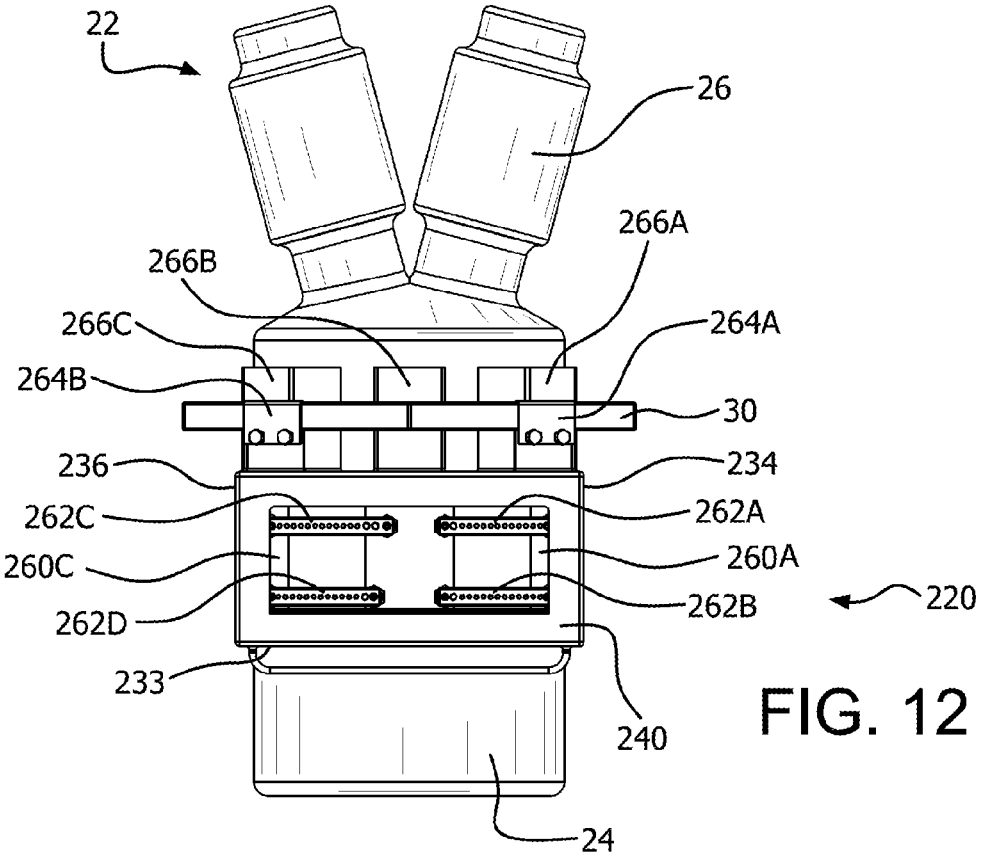
FIG. 12 is a front view of the transformer and security enclosure of FIG. 10.
Figure 13:
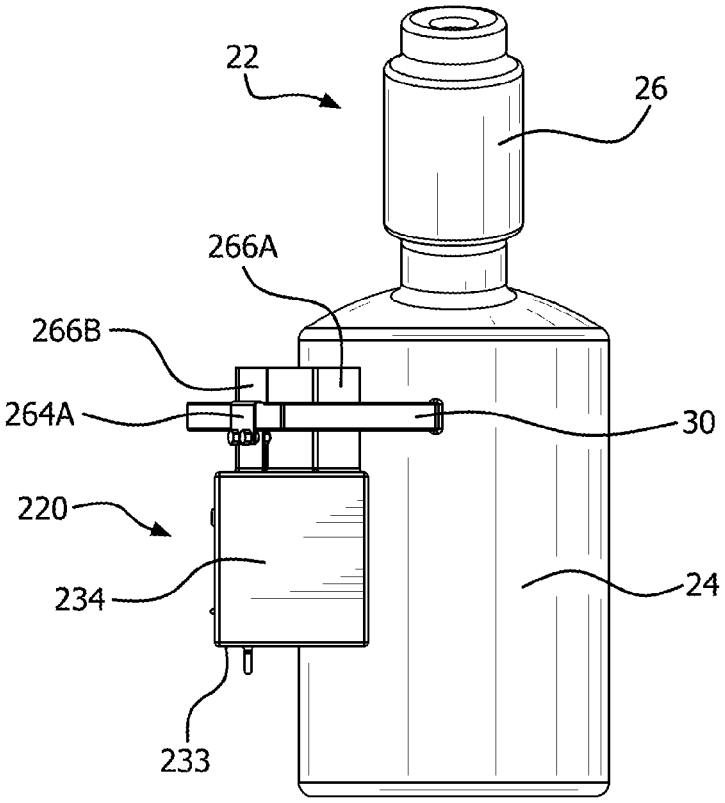
FIG. 13 is a right side view of the transformer and security enclosure of FIG. 10.

FIGS. 1-5 depict an exemplary embodiment of the enclosure 20 connected to the transformer 22 and FIGS. 6-8 depict another exemplary embodiment of the enclosure 120. The exemplary enclosures 20, 120 have a number of corresponding features that may be described once and use the same reference numerals. In various exemplary embodiments, the enclosure includes a bottom wall 32, a first sidewall 34, a second sidewall 36, a first rear wall 38A, and a second rear wall 38B surrounding an interior. The first and second sidewalls 34, 36 extend upwardly from the bottom wall 32 and can be connected to the top bar 30, for example, by fastening or welding. The first and second sidewalls 34, 36 may be connected to the tank 24 through other structures, such as a lifting lug, with the connection dependent on the configuration and design of the transformer 22. The bottom wall 32 has a tank aperture positioned at a rear edge and configured to receive the transformer tank 24. In the exemplary embodiment, the tank aperture is a semi-circular opening. The size, shape, location, and configurations of the tank aperture may vary depending on the transformer 22. The security enclosure 20 also includes one or more conductor apertures, for example first and second conductor apertures 21A, 21B. A first rear wall 38A and a second rear wall 38B extend from a distal end of the first and second sidewalls 34, 36, respectively. The first and second rear walls 38A, 38B extend adjacent to the tank 24 to block access to the security enclosure 20 from the rear. A first front flange 40A and a second front flange 40B extend from a front or proximal end of the first and second sidewalls 34, 36, respectively. In various exemplary embodiments, handles 42A, 42B extend from the first and second sidewalls 34, 36 and a positioning bar 43 extends from the bottom wall 32. The walls of the enclosure may be made from a plastic, metal, ceramic, or composite material, or any combination thereof.

In various exemplary embodiments, the security enclosure 20 includes a moveable top cover 44 and a moveable front door 46. The top cover 44 can slidably connect to the first and second sidewalls 34, 36 as best shown in FIG. 6. The slidable connection allows the top cover 44 to linearly or translationally slide toward and away from the tank 24. The front door 46 pivotally connects to the bottom wall 32. The top cover 44 and front door 46 may be made from a plastic, metal, ceramic, or composite material, or any combination thereof. In certain embodiments, different types of connection can be used for the cop cover 44 and the front door 46.

The top cover 44 includes a top surface 48 and an opening configured to receive the transformer tank 24. In the exemplary embodiment, the opening is a semi-circular opening. The size, shape, location, and configurations of the opening may vary depending on the transformer 22. An outer flange 50 extends downwardly from the top surface 48 towards and overlapping ends of the first and second sidewalls 34, 36 on three sides of the top cover 44.

As best shown in the exemplary embodiment of FIG. 8, the top cover 144 slidably connects to the first and second sidewalls through a linear slide 52 or a pair of linear slides (only one shown). The linear slide 52 includes a rail mounted on the second sidewall 36 and a rail mounted on the top cover 144. One or more wheels or bearings may be connected to the first rail, the second rail, or both rails to ease movement between the first and second rails. In alternative embodiments, sets of mating flanges may be provided on the top cover 144 and the first and second sidewalls 34, 36 to facilitate a mating sliding engagement without any additional components. Other linear slides can be used to slidably connect the top cover 144 to the first and second sidewalls 34, 36 as would be understood by one of ordinary skill in the art. The top cover 144 is slidable between a closed position covering the interior of the enclosure 120 and an open position that at least partially exposes the interior of the enclosure 120.

The front door 46 is substantially rectangular and is connected to the bottom through one or more hinges 56, for example a pair of barrel hinges positioned at opposite ends of front door 46 or a flat hinge extending at least partially along the front door 46. The front door 46 rotates between a closed position adjacent the first and second front flanges 40A, 40B and an open position exposing the interior of the enclosure 20. The front door 46 includes a slot 58 or opening to receive the lock 54, for example the latch from a cam lock. The slot 58 allows the front door 46 to be secured in the closed position when the top cover 44 is locked. In various exemplary embodiments, the top edge of the front door 46 is secured in the closed position by the flange 50 of the top cover 44, preventing the front door 46 from moving to an open position when the top cover 46 is in the closed positioned or substantially close thereto.

Figure 1:
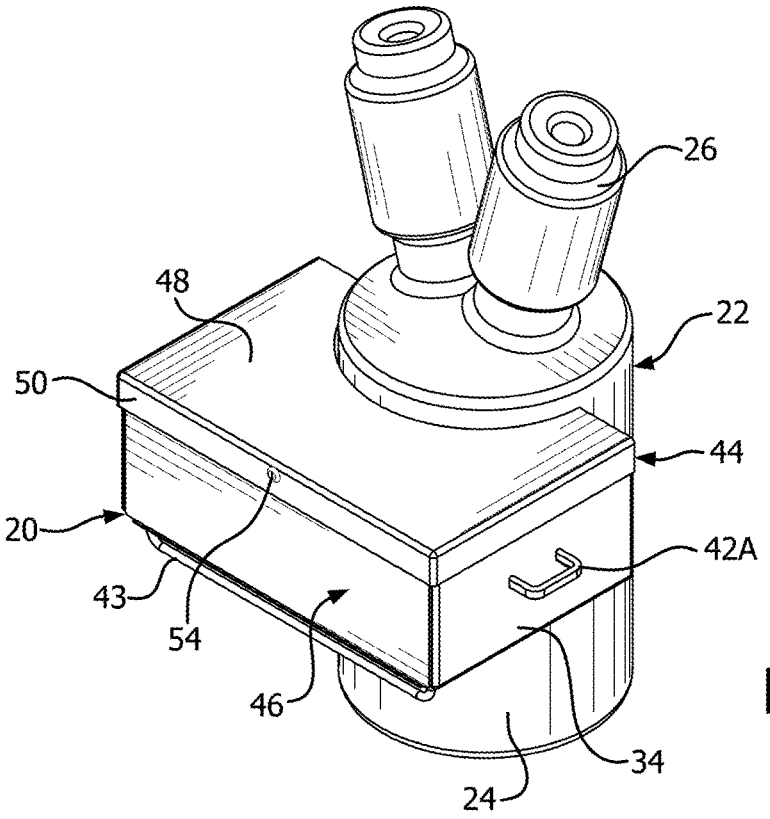
FIG. 1 is a top perspective view of a transformer and a security enclosure according to an exemplary embodiment.
Figure 2:
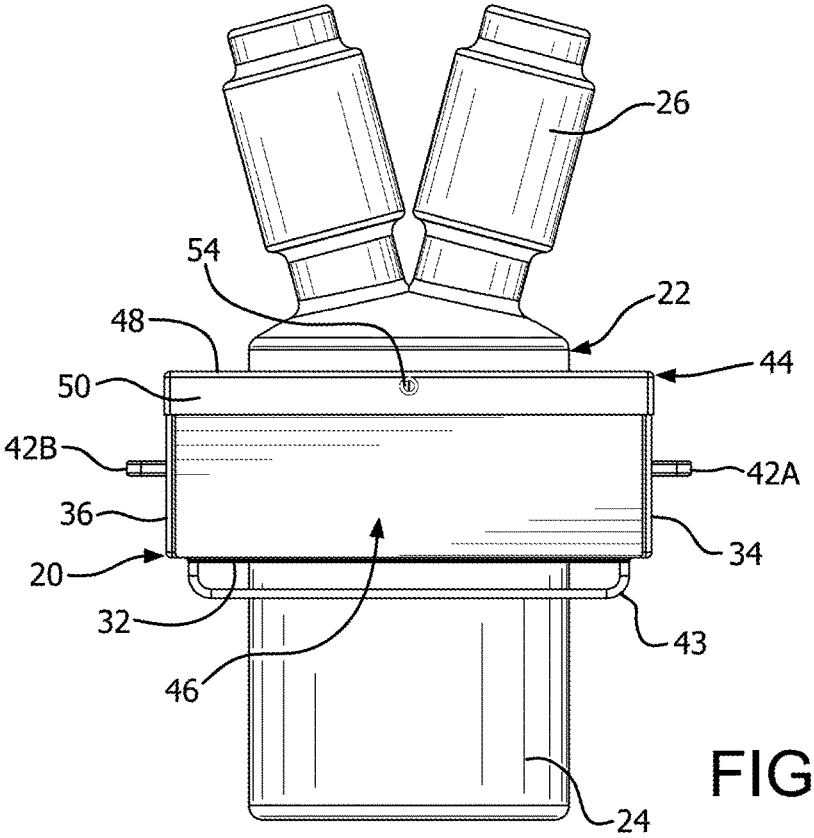
FIG. 2 is a front view of the transformer and security enclosure of FIG. 1.

In an exemplary embodiment, a lock 54 is positioned on the top cover 44 to lock the top cover 44 in the closed position. In various exemplary embodiment, the lock 54 is a cam lock. Any type of lock may be used as desired or required for the structure of the enclosure. The lock 54 is positioned on the center of the flange 50 as shown in FIGS. 1 and 2. The lock 54 connects to a locking bar 55 extending from a panel 60B.

In another exemplary embodiment, the lock 154 is positioned on the side of the flange 150 as shown in FIGS. 6-8. As best shown in FIG. 7, when the top cover 144 and front door 146 are in the closed position, the lock 154 extends through the slot 158 in the front door 146 and can be rotated to be positioned behind the first front flange 40A to secure the top cover 144 and the front door 146.

The interior of the enclosure 20 includes at least one panel. The exemplary embodiments shown in FIGS. 3, 4, and 5 include two panels 60A, 60B, although different numbers of panels may be used as needed. The panels 60A, 60B are spaced from the tank 24, to provide room for the low voltage bushings 28 and are angled in the enclosure 20, although other configurations may be used. The panels 60A, 60B may be connected to the bottom wall 32 of the enclosure 20 or they may be hung or otherwise connected to the top bar 30. One or more openings 61 extend through the panels 60A, 60*b* to allow conductors $C_1$ connected to the low voltage bushings 26 to pass through the panels 60A, 60B.

One or more terminal blocks are connected to the panels, for example through welding or mechanical fasteners. In the exemplary embodiment shown in FIGS. 3, 4, and 5 four terminal blocks 62A-62D are used with two connected to each panel 60A, 60B. Fewer or more than four terminal blocks 62A-62D may also be used depending on the needs of the system. The terminal blocks 62A-62D are electrically conductive and include multiple ports to receive electrical conductors. The conductors $C_1$ connected to the low voltage bushings extend through the panels 60A, 60B and are connected to the terminal blocks 62A-62D to act as primary conductors. Depending on the number of low voltage bushings 28 and the number of terminal blocks 62A-62D used, one or more terminal blocks may be bridged to another terminal block to receive electrical power. Secondary or tap conductors $C_2$ may be connected to the open ports to deliver power to an end consumer. The enclosure 20 includes one or more openings to permit passage of the tap conductors $C_2$. In the exemplary embodiment shown, the openings 21A, 21B are located in the bottom wall 32 of the enclosure 20. The openings 21A, 21B are sized to permit passage of a tap conductor $C_2$ but otherwise limit access to the interior of the enclosure 20.

FIGS. 9-13 depict another exemplary embodiment of an enclosure 220 connected to a transformer 222. The enclosure includes a bottom wall 232, a top wall 233, a first sidewall 234, a second sidewall 236, a first rear wall 238A, and a second rear wall 238B surrounding an interior. The first and second sidewalls 234, 236 extend upwardly from the bottom wall 232 and are connected to the top wall 233. The bottom wall 232 and the top wall 233 have openings positioned at their rear edges configured to receive the transformer tank 24. In the exemplary embodiment, the openings are semi-circular openings. The size, shape, location, and configurations of the openings may vary depending on the tank 24. A first rear wall 238A and a second rear wall 238B extend from a distal end of the first and second sidewalls 234, 236, respectively. The first and second rear walls 238A, 238B extend adjacent to the tank 24 to block access to the enclosure from the rear. A front flange 240 extends from a proximal end of the first and second sidewalls 234, 236, the top wall 233, and the bottom wall 232 to surround an opening to the interior.

In accordance with an exemplary embodiment, a first hook 264A and a second hook 264B extend from the top wall 233 to connect the enclosure to the top bar 30. The hooks 264A, 264B are substantially J-shaped, and include one or more sets of aligned apertures. Mounting hardware, for example mechanical fasteners extend through the apertures to secure the hooks 264A, 264B to the top bar 30. The hooks 264A, 264B may be unitarily formed with the top wall 233 or connected to the top wall 233, for example through welding.

One or more shafts 266A-266C extend upward from the top of the enclosure. Each shaft 266A-266C surrounds and/or extends above a low voltage bushing 28 extending from the tank 24. In the exemplary embodiment shown, the enclosure includes three shafts 266A-266C, one for each low voltage bushing 28. The number of shafts 266A-266C may vary depending on the number of low voltage bushings 28, and more than one bushing may be covered by a single shaft. The size, shape, spacing, and configuration of the shaft can also be varied.

A front cover 246 pivotally connects to the front flange 240. The front cover 246 is rotated between a closed position covering the opening to the interior and an open position allowing access to the interior. The front cover 246 includes a lock 254 for securing the front cover 246 in the closed position. In an exemplary embodiment, the lock 254 is a cam lock. Any type of lock may be used as desired or required for the structure of the enclosure.

The interior includes one or more panels 260A-260C, openings, and terminal blocks 262A-262D similar to those discussed above with respect to the exemplary embodiment shown in FIGS. 1-6. The panels 260A-260C are connected to the bottom of the enclosure spaced from the tank, to provide room for the low voltage bushings 28. The openings are substantially square openings although various sizes and shapes may be used.

One or more terminal blocks 262A-262D are connected to the panels 260A-260C for example through welding or mechanical fasteners. In the exemplary embodiment shown in FIG. 9, four terminal blocks 262A-262D are used with two terminal blocks bridging each opening. Fewer or more than four terminal blocks 262A-262D can be used depending on the needs of the system. The terminal blocks 262A-262D are electrically conductive and include multiple ports to receive electrical conductors. Conductors connected to the low voltage bushings 28 extend through the openings and are connected to the terminal blocks 262A-262D to act as primary conductors. Depending on the number of low voltage bushings 28 and the number of terminal blocks 262A-262D used, one or more terminal blocks may be bridged to another terminal block to receive electrical power. Secondary or tap conductors (not shown) may be connected to the open ports to deliver power to an end consumer. The enclosure 220 may include one or more openings 221A, 221B to permit passage of the tap conductors. In the exemplary embodiment shown, the openings 221A, 221B are located in the bottom of the enclosure 220. The openings 221A, 221B are sized to permit passage of a conductor but otherwise limit access to the interior of the enclosure 220.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A secure enclosure for a transformer comprising:

a bottom, a first sidewall extending from the bottom, and a second sidewall extending from the bottom at least partially enclosing an interior, the bottom having a tank aperture configured to receive a transformer tank;

a front opening providing access to the interior;

a first panel positioned in the interior;

at least one terminal block connected to the first panel;

a door pivotable between an open position spaced from the front opening and a closed position covering the front opening; and a lock releasably securing the front door in the closed position.

2. The enclosure of claim 1, wherein the bottom includes a plurality of conductor apertures.

3. The enclosure of claim 1, wherein a second panel is positioned in the interior and the first panel and the second panel are obliquely angled with respect to one another.

4. The enclosure of claim 1, wherein the tank aperture is a semi-circular opening.

5. The enclosure of claim 1, wherein the panel comprises a conductor aperture.

6. The enclosure of claim 1, wherein the terminal block bridges an opening adjacent to the panel.

7. The enclosure of claim 1 wherein a top cover is slidably connected to the first and second sidewalls and is moveable between a closed and an open position.

8. The enclosure of claim 7, wherein a lock is positioned on the top cover.

9. The enclosure of claim 7, wherein the top cover in the closed position prevents movement of the door.

10. The enclosure of claim 1, further comprising a top wall connected to the first and second sidewalls.

11. The enclosure of claim 10, wherein at least one hook extends from the top wall.

12. The enclosure of claim 10, wherein at least one shaft extends from the top wall.

13. A secure enclosure for a transformer comprising:

a bottom having a tank aperture;

a first sidewall extending from the bottom;

a second sidewall extending from the bottom, the bottom, first sidewall, and second sidewall at least partially enclosing an interior;

a front opening providing access to the interior;

a first panel positioned in the interior;

at least one terminal block connected to the first panel;

a top cover slidable between a closed position and an open position to selectively cover the interior; and a door pivotable between an open position spaced from the front opening and a closed position covering the front opening.

14. The enclosure of claim 13, wherein the top cover is connected to the first sidewall by a linear slide.

15. The enclosure of claim 13 wherein a cam lock is configured to secure the door in the closed position.

16. A transformer having a secure enclosure comprising:

a transformer having a tank and a low voltage bushing extending from the tank;

an enclosure connected to the transformer at least partially enclosing an interior around the low voltage bushing;

a front opening providing access to the interior;

a first panel positioned in the interior;

a second panel positioned in the interior;

at least one terminal block connected to the first panel and the second panel, and electrically connected to the low voltage bushing;

a door pivotal between an open position and a closed position covering the front opening; and a lock configured to secure the front door in the closed position.

17. The transformer of claim 16, wherein a top bar extends from the tank and the enclosure is connected to the top bar.

18. The transformer of claim 16, wherein the enclosure includes a top cover slidably connected to a first and second sidewall.

19. The transformer of claim 18, further comprising a top wall connected to the first and second sidewalls, a hook extending from the top wall, and at least on shaft extends from the top wall.

* * * * *